US007726099B2

(12) United States Patent
Boice, III et al.

(10) Patent No.: US 7,726,099 B2
(45) Date of Patent: Jun. 1, 2010

(54) SEMI-AUTOMATIC (HUMAN POWERED) CASE SEALING MACHINE

(75) Inventors: Hugh Kendall Boice, III, Russell, OH (US); Thomas Westlake Buschman, Kirtland, OH (US); Westlake David Buschman, Cleveland, OH (US)

(73) Assignee: Better Case Sealer LLC, Russell, OH (US)

( * ) Notice: Subject to any disclaimer, the term of this patent is extended or adjusted under 35 U.S.C. 154(b) by 95 days.

(21) Appl. No.: 11/975,965

(22) Filed: Oct. 23, 2007

(65) Prior Publication Data

US 2008/0092484 A1 Apr. 24, 2008

Related U.S. Application Data

(60) Provisional application No. 60/854,311, filed on Oct. 24, 2006.

(51) Int. Cl.
*B65B 51/06* (2006.01)
*B29C 65/00* (2006.01)

(52) U.S. Cl. ..... 53/416; 53/136.4

(58) Field of Classification Search ..... 53/415, 53/410, 416, 419, 135.1, 136.4; 156/527, 156/574, 577, 579, 538, 542, 468, 475, 477.1, 156/486, 492, 526, 523
See application file for complete search history.

(56) References Cited

U.S. PATENT DOCUMENTS 3,027,292 A * 3/1962 Rothenberger ..... 156/468
3,762,283 A 10/1973 Renner
3,775,937 A 12/1973 Devan et al.
3,915,786 A 10/1975 Collett et al.
3,954,550 A * 5/1976 Patterson ..... 156/486
4,161,138 A 7/1979 Marchetti
4,585,504 A 4/1986 Marchetti
4,617,081 A * 10/1986 Bleau et al. ..... 156/443
4,671,440 A 6/1987 Marchetti
4,936,945 A 6/1990 Marchetti
5,025,608 A 6/1991 Marchetti
5,223,075 A * 6/1993 Sims ..... 156/468
5,338,384 A * 8/1994 Reichert ..... 156/212
5,454,776 A 10/1995 Ulrich et al.
5,725,721 A * 3/1998 Yeh ..... 156/468
6,067,773 A 5/2000 Le
6,910,314 B2 6/2005 Le

* cited by examiner

*Primary Examiner*—Rinaldi I. Rada
*Assistant Examiner*—John Paradiso
(74) *Attorney, Agent, or Firm*—Fay Sharpe LLP

(57) ABSTRACT

A case sealing device is provided for applying a sealing tape to a surface of a case to be sealed. The device includes a work surface. A first portion of the work surface defines an entry region and a second portion of the work surface defines an exit region. A taping assembly is mounted adjacent the work surface between the entry region and the exit region. The taping assembly includes a taping head and a taping head linkage. The linkage has a rotatable first end and a second end. The second end is secured to the taping head. The taping head is adapted to hold an associated roll of tape. The taping head and the taping head linkage are configured to cooperate to dispense a strip of the tape from the taping head onto the surface of the case to be sealed as the case to be sealed is brought into contact with the taping assembly during sliding movement from the entry region to the exit region of the work surface.

17 Claims, 12 Drawing Sheets

SEMI-AUTOMATIC (HUMAN POWERED) CASE SEALING MACHINE

A claim for domestic priority is made herein under 35 U.S.C. §119(e) to U.S. Provisional App. Ser. No. 60/854,311 filed on Oct. 24, 2006, the entire disclosure of which is incorporated herein by reference.

BACKGROUND

The present application relates to the general field of packaging. It finds particular application to packaging equipment used to tape or seal shipping containers, cases, boxes, or cartons and will be described with reference thereto. However, other applications are also contemplated.

It is well known that merchandise and the like are commonly shipped or transported in rectangular cardboard containers or cases. Typically, these cases are supplied as a flat sheet and must be erected (or folded into a rectangular cube) and partially sealed before they can be used. In high volume shipping and packaging facilities, this process is performed by an automatic machine known as a case erector/sealer. In lower volume facilities, the cases are individually erected and manually sealed using a handheld unit commonly referred to as a "taping gun."

For reasons which are obvious, manually erecting and sealing cases is laborious and, in particular, time consuming. In addition, handheld taping guns are not consistent in applying a reliable tape seal. In many instances, the user must hold the loose or open flaps of the case closed while attempting to operate the taping gun in sealing the case. Since sealing a case is a relatively precarious operation for a single individual, portions of the sealing tape often fail to adhere reliably to the case, fold and adhere to itself, or otherwise adhere in an improper or off-center location on the case. For example, if the end portions of the tape are not adhered properly, they could catch on a foreign object causing the tape to become detached and possibly spoiling the case.

On the other hand, automatic case erectors/sealers are complicated to operate, require frequent maintenance, and are cost prohibitive for many medium and small sized businesses. In addition, automatic case sealers are typically limited to a specific range of case sizes.

For at least these reasons, a need exists to provide a simple, versatile, reliable, and cost effective case sealing machine designed to accommodate medium to low volume packaging operations. Thus, the present application provides an improved device and a method that overcome the aforementioned problems and others.

SUMMARY

According to one aspect of the present invention, a case sealing device is provided for applying a sealing tape to a surface of a case to be sealed. The device includes a work surface. A first portion of the work surface defines an entry region and a second portion of the work surface defines an exit region. A taping assembly is mounted adjacent the work surface between the entry region and the exit region. The taping assembly includes a taping head and a taping head linkage. The linkage has a rotatable first end and a second end. The second end is secured to the taping head. The taping head is adapted to hold an associated roll of tape. The taping head and the taping head linkage are configured to cooperate to dispense a strip of the tape from the taping head onto the surface of the case to be sealed as the case to be sealed is brought into contact with the taping assembly during sliding movement from the entry region to the exit region of the work surface.

According to another aspect of the present invention, a method is provided of sealing a surface of a case to be sealed with tape. The method includes advancing a case to be sealed along a work surface. A first end of a length of the tape extending along an applicator surface contacts a first wall surface of the advancing case to adhere the first end of the tape to the first wall surface. With continued advancement of the case to be sealed, a linkage that supports the applicator surface is rotated while the tape is dispensed against the first wall surface of the advancing case. With continued advancement of the case to be sealed, the linkage is further rotated to cause the applicator surface to round a forward edge of the advancing case. With continued advancement of the case to be sealed, the tape is pressed against a second wall surface of the advancing case. With continued advancement of the case to be sealed, the tape is cut and a cut end portion of the tape is adhered against a third wall surface of the advancing case.

BRIEF DESCRIPTION OF THE DRAWINGS

The invention may take form in various components and arrangements of components and various steps and arrangement of steps. The drawings are only for purposes of illustrating various embodiments of the invention and are not to be construed as limiting the invention.

DETAILED DESCRIPTION

Figure 1:
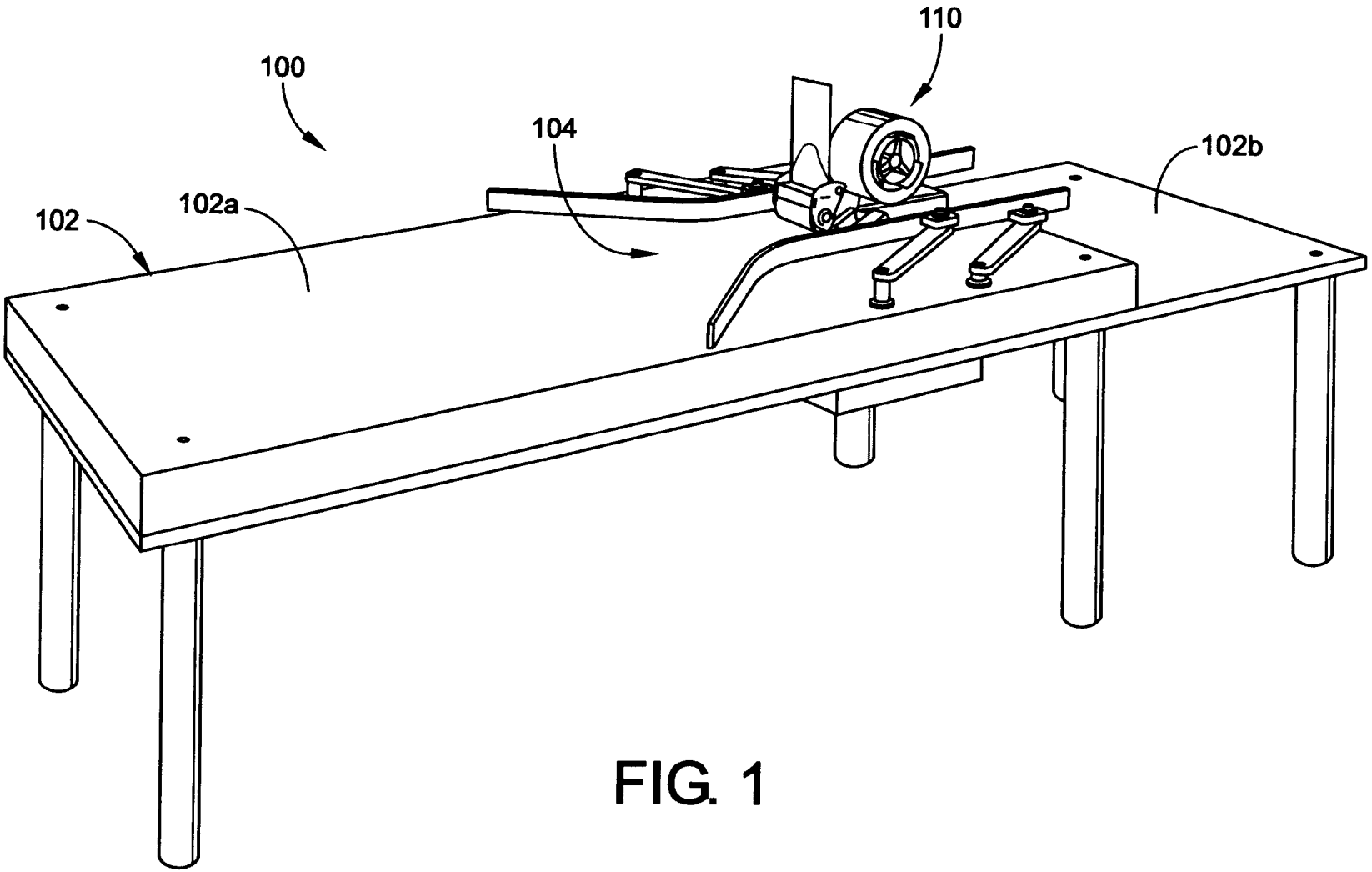
FIG. 1 is a perspective view from a right or front side of a first embodiment of a case sealing device illustrating a work table, a self-centering guide assembly, and an articulated taping head assembly.
Figure 2:
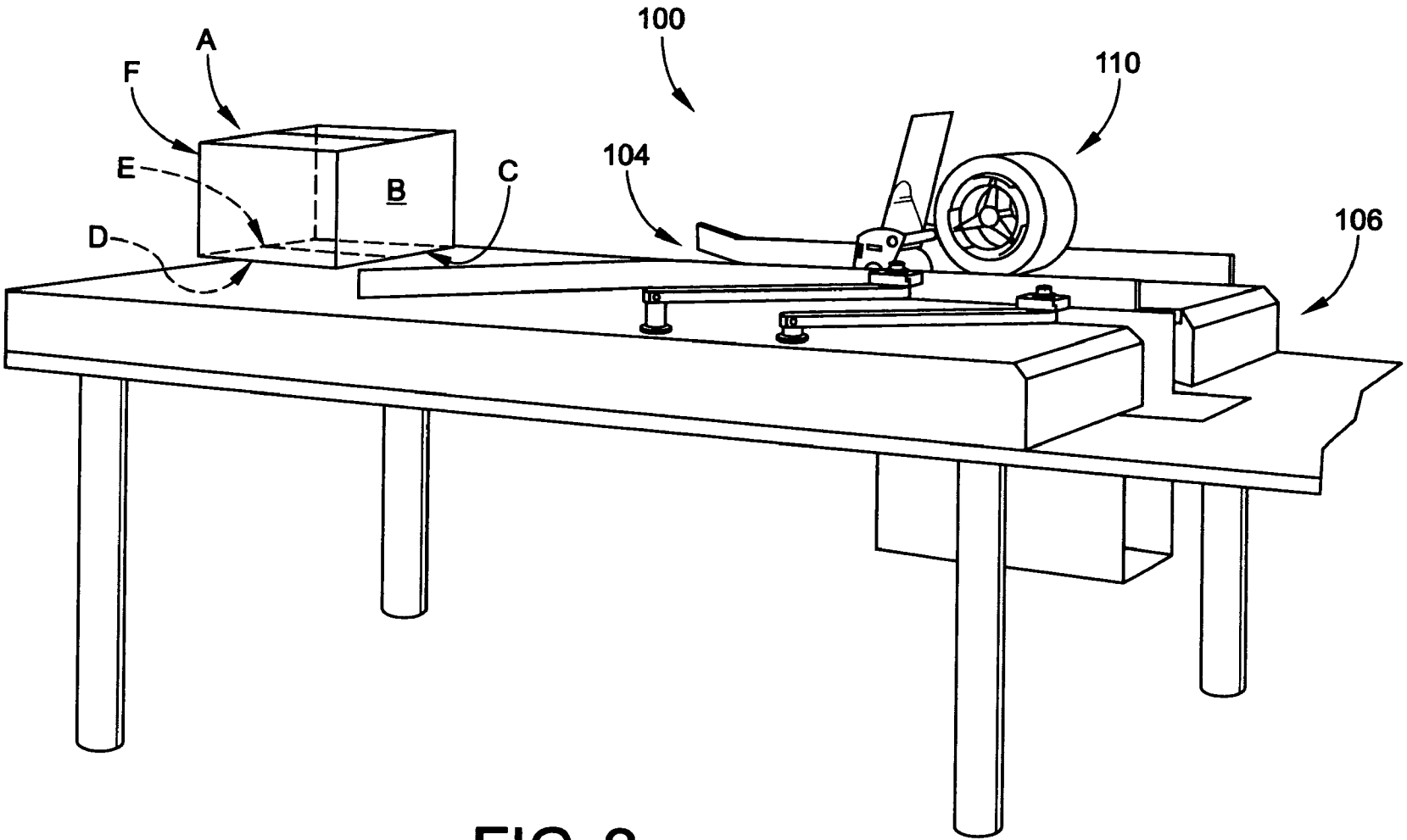
FIG. 2 is a perspective view from a right or rear side of the case sealing device of FIG. 1 illustrating a work surface having an exit region lower than an entry region.
Figure 3:
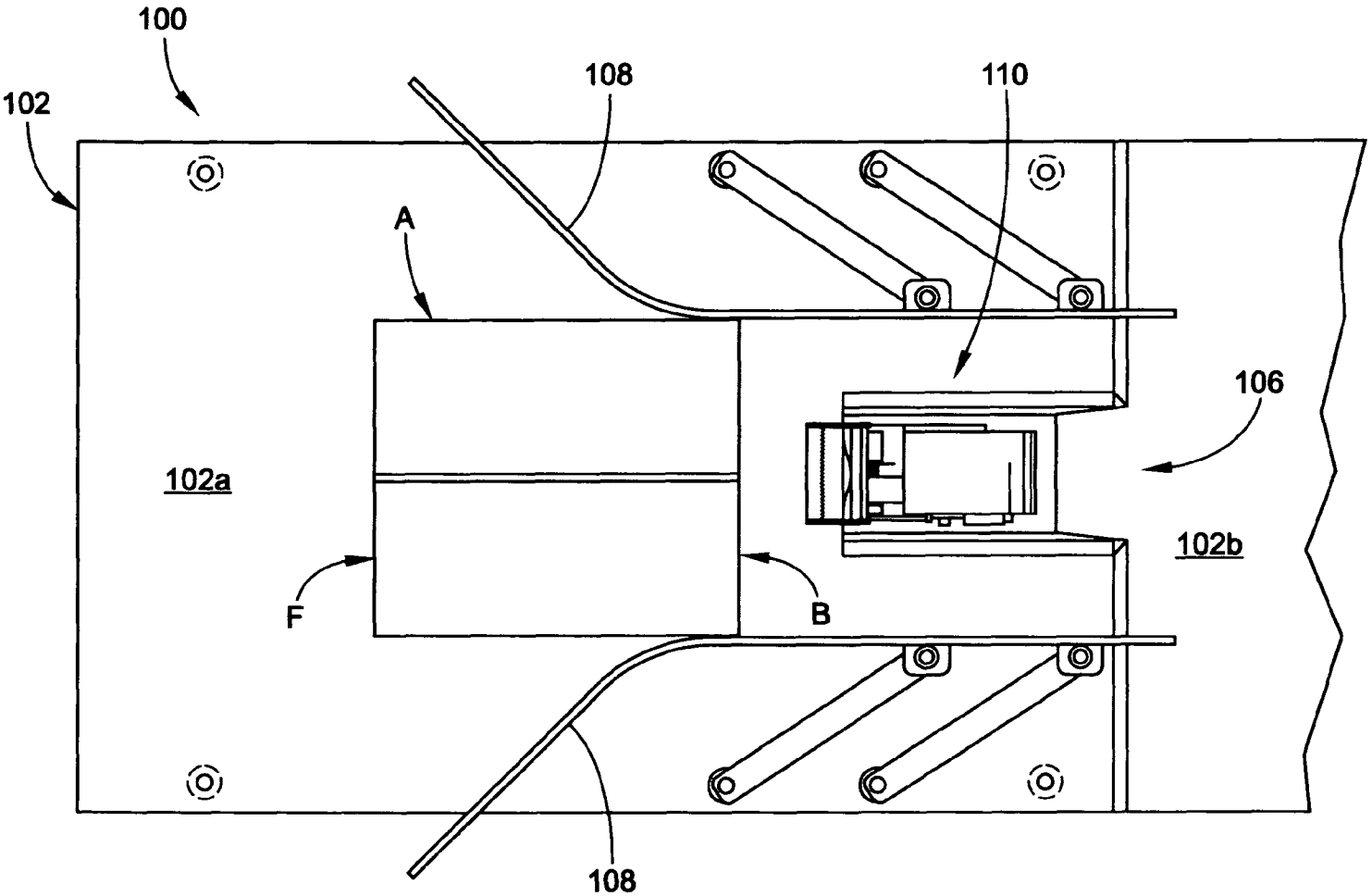
FIG. 3 is a top plan view of the case sealing device of FIG. 1.

With reference to FIGS. 1-3, a first embodiment of a case sealing machine 100 is shown. The sealing machine 100 includes a work surface 102 having a first elevation 102*a* corresponding with an entry region 104 and a second, lower elevation 102*b* corresponding with an exit region 106. In addition, the sealing machine 100 includes a pair of generally parallel self-centering guides 108 mounted to the work surface 102 and disposed about a taping assembly 110.

To aid in the discussion of the overall structure and function of the case sealing machine 100, a brief recitation of operation is set forth. Generally, a case A (which has been at least partially erected) is received at the entry region 104 against the work surface 102 and between the centering guides 108. As, the user of the machine 100 applies a moderate downward and forward pressure on the case A, the case A is driven through the centering guides 108. The centering guides 108 center the case A with respect to the taping assembly 110. Once the centering guides 108 have expanded to the appropriate width to accommodate the centered case A, the taping assembly 110 comes into contact with a first or forward wall surface B of the case A where a beginning of a strip of tape is adhered to the forward wall surface B. As the case A is pushed through the guides 108 and along the work surface 102, the taping assembly 110 begins to pivot in a rearward fashion allowing the taping assembly 110 to move and adhere the tape down the forward wall B, round over a lower forward edge C of the box, and to a second or bottom wall surface D of the case A. Eventually, a rear edge E of the case A moves past the taping assembly 110. At this point the case A is received into the exit region 106 which is at a lower elevation than the entry region 104. As the user continues to urge the case A downward, the case A begins to drop to the second level where the tape is cut and an end portion of the tape is adhered to a third or rear wall surface F of the case A. To lessen user effort and long term fatigue, the centering guides and work surface can include a low friction coating or film (e.g. Teflon) thereby reducing the sliding friction between the machine and the case.

Each of the centering guides 108 can be operatively connected to the other via a linkage and/or a cable system such that both centering guides 108 move in equal yet opposite directions simultaneously. For example, a four bar linkage can be connected to the spindles of the centering guides. A plurality of pulleys connected are to the spindles and/or linkages while a cable follows a figure "8" pattern about the plurality of pulleys. As such, when one guide is pushed backward/outward against the resistance of a biasing force (e.g. a gas cylinder or spring), the other guide responds similarly but in the opposite direction and by the same amount. Since both guides retract or expand equally but in opposite directions, the case A will naturally take the path of least resistance traveling along the centerline of the taping assembly 110.

Figure 4:
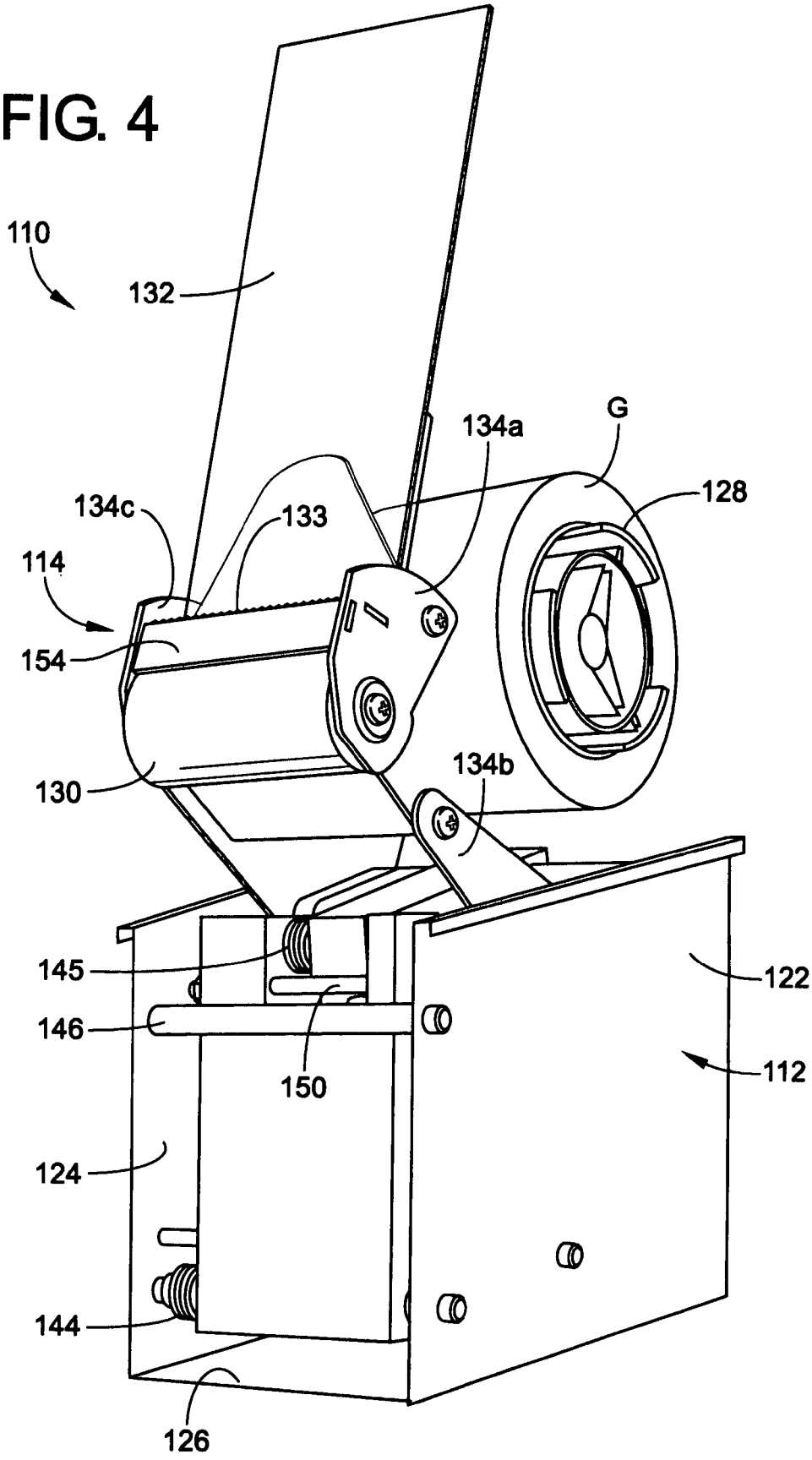
FIG. 4 is a perspective view from a right or front side of a taping head assembly of the case sealing device of FIG. 1, illustrating a taping head and a taping head linkage.
Figure 5:
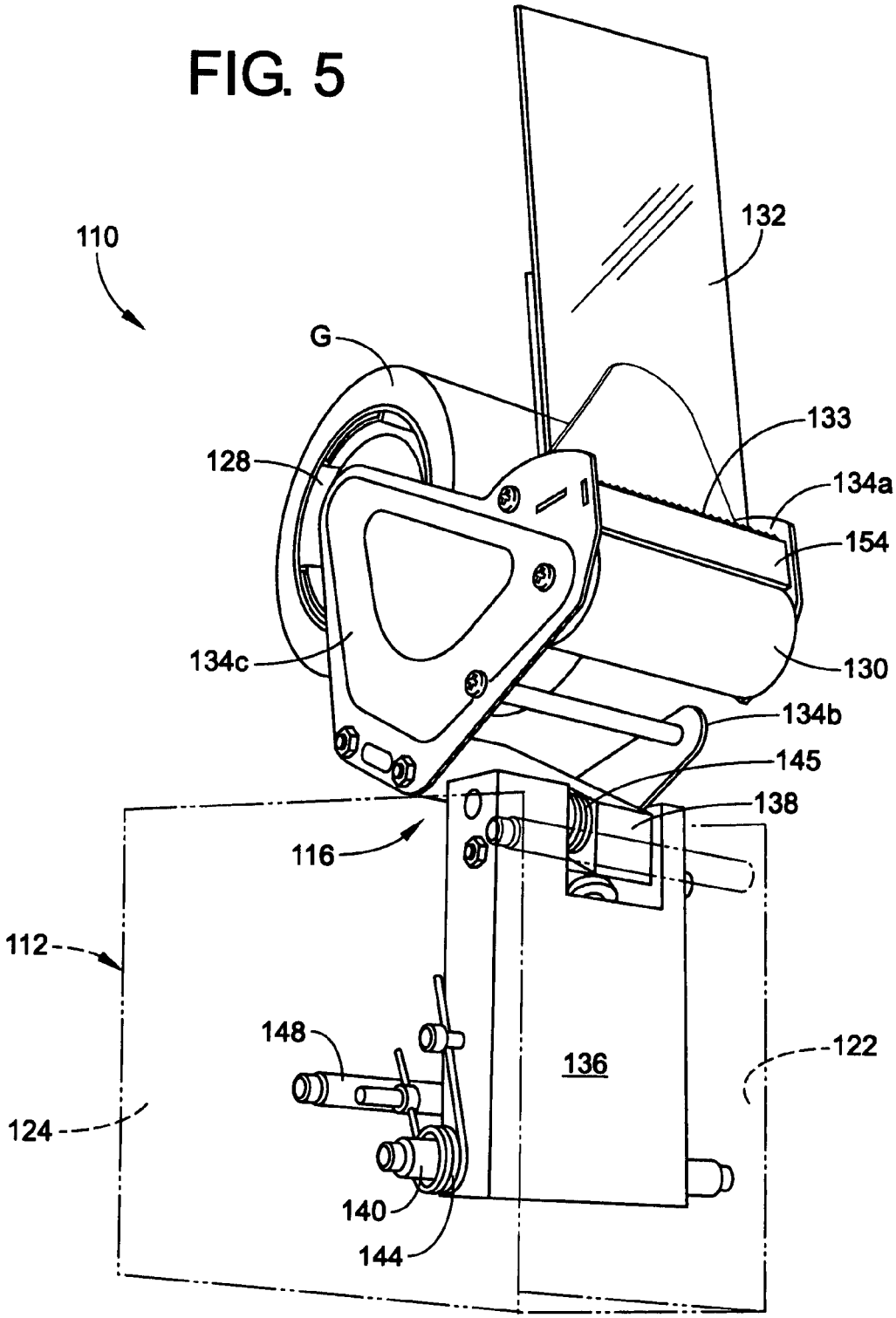
FIG. 5 is a perspective view from a left or front side of the taping head assembly of the case sealing device of FIG. 1 with the housing shown transparently in phantom.
Figure 6:
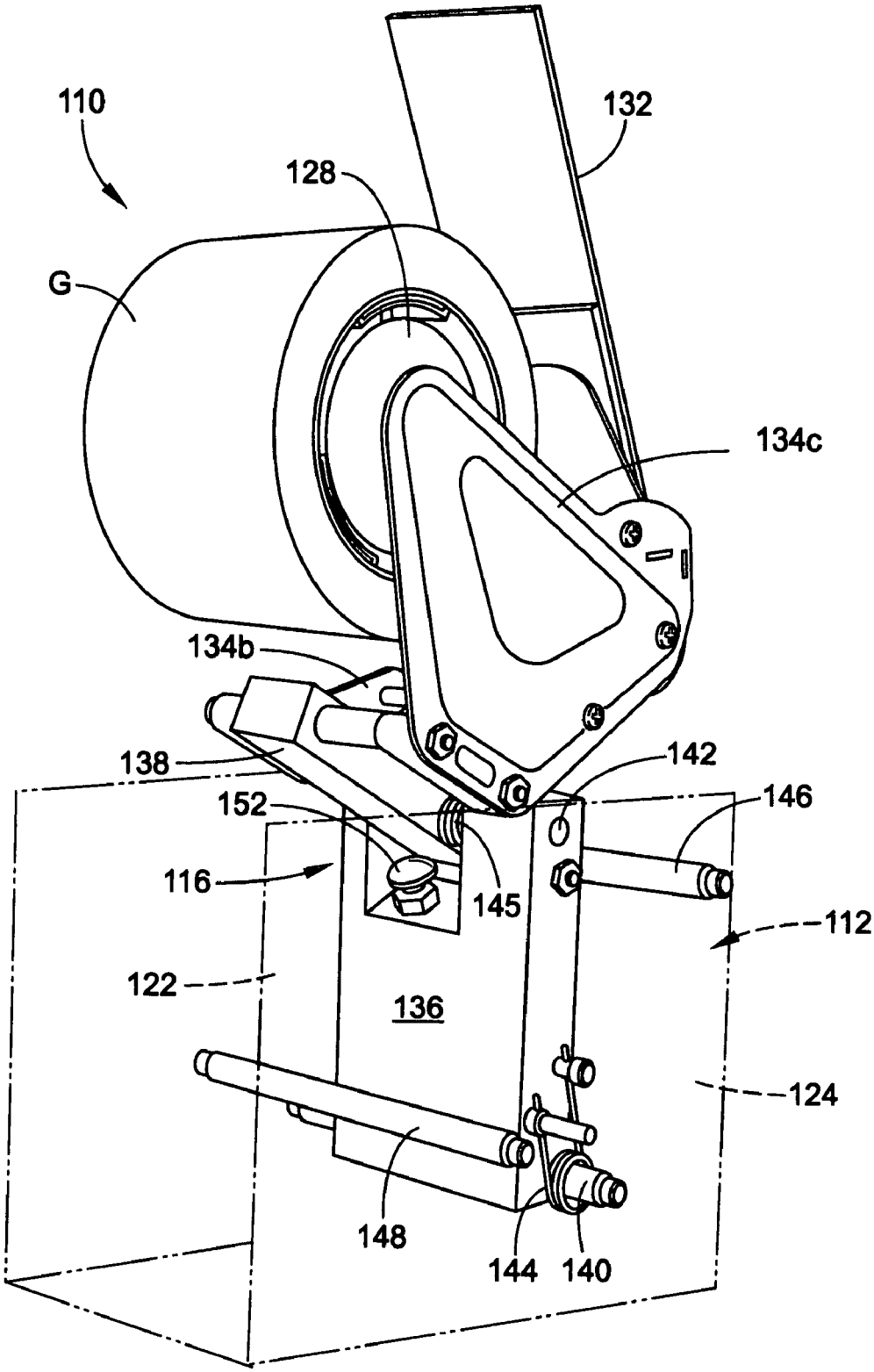
FIG. 6 is a perspective view from a rear side of the taping head assembly of FIG. 1, illustrating a first stop and a second stop of the taping head linkage with the housing shown transparently in phantom.

With reference now to FIGS. 4-6, various perspective views of the taping assembly 110 are shown. Generally, the taping assembly 110 includes a frame or housing 112 for supporting a taping head 114 and a taping head linkage 116. The housing 112 can be releasably secured to the work surface or table (e.g. via one or more clips, clevis pins, threaded fasteners, etc.) such that the taping assembly 110 can be removed with ease for periodic maintenance, adjusting, and/or replacement. The housing can include a first side wall 122, a second side wall 124, and a lower or lateral support member 126. The taping head 114 includes a tape roll 128 for receiving the roll of adhesive tape G, an application roller 130 for applying the adhesive tape to the associated carton or case A (FIG. 2), a wiper arm 132, and a cutter 133. The general purpose of the wiper arm 132 (discussed in greater detail below) is to press and smooth the trailing end portion of the tape against the rear wall surface F of the case once the tape has been cut by a cutter or cutting edge 133. The taping head further includes a first support 134*a* plate, a second support plate 134*b*, and a third support plate 134*c* which generally secure the tape roll 128 and the application roller 130 to the taping head linkage 116.

With reference to FIGS. 5 and 6, the taping head linkage 116 of the taping head assembly 110 is shown in greater detail. The taping head linkage 116 includes a first arm or link 136 and a second arm or link 138. The first arm 136 is rotatably secured by a first pin 140 between the first and second housing walls 122,124 and the second arm 138 is rotatably supported by the first arm 136 by a second pin 142 disposed at a distal end of the first arm 136. The first arm 136 pivots about the first pin 140 and the second arm 138 pivots about the second pin 142. The first arm and the second arm may also include respective first and second biasing members 144, 145. In addition, the first, second, and third support plates 134*a*-134*c* secure the taping head 114 to the second arm 138.

Generally, as a case is brought into contact with the application roller 130, the taping head 114 pivots rearwardly about the first and second pins 140,142 and follows a curvilinear path defined by the individual rotation of each of the first and second arms 136,138. By adjusting the biasing force or tension of the biasing members 144, 145, the movement of the first and second arms 136,138 can be proscribed accordingly. By way of example only, if the biasing factors (e.g. 'K' factor or spring constant) of the first and second biasing members 144, 145 are equivalent, then the first arm 136 will deflect or pivot about the first pin 140 before the second arm 138 deflects or pivots about the second pin 142. This occurs because the first arm 136 (if longer in length than the second arm 138) will develop a greater moment arm or torque.

With continued reference to FIGS. 4-6, the taping assembly 110 includes a variety of stops or limits, some of which are adjustable. In general, these stops define the forward/uppermost and rearward/lowermost positions of the taping head 114. In particular, the first arm 136 includes a forward stop 146 and a rear stop 148. As shown, both first arm stops 146,148 may include a dowel or pin having internally thread ends for securing the stops to the housing 112 of the assembly 110. Furthermore, the housing 112 may include multiple lengthwise slots for adjusting the stops 146,148 in a forward or rearward direction to optimize the taping action of the assembly 110. Similarly, the second arm 138 also includes a forward stop 150 and a rear stop 152. The forward and rear stops 150,152 of the second arm 138 are attached to the first arm 136. Thus, the overall travel of the second arm 138 can be adjusted with respect to the first arm 136. For instance, and by way of example only, as the second arm 138 pivots upwards, a lower surface of the second arm 138 can eventually encounter the forward stop 150. Similarly, as the second arm 138 pivots downwards it will eventually encounter or interfere with the rear stop 152. However, unlike the forward stop 150, the rear stop is adjustable by undoing a locking nut and threading the rear stop 152 into or out of the first arm 136. By threading the rear stop 152 into the first arm 136, the amount of rearward travel of the second arm 138 (and the taping head 114) is increased. Of course, any number of techniques may be used to adjust the range of motion of the first and second arms 136,138.

Figure 7:
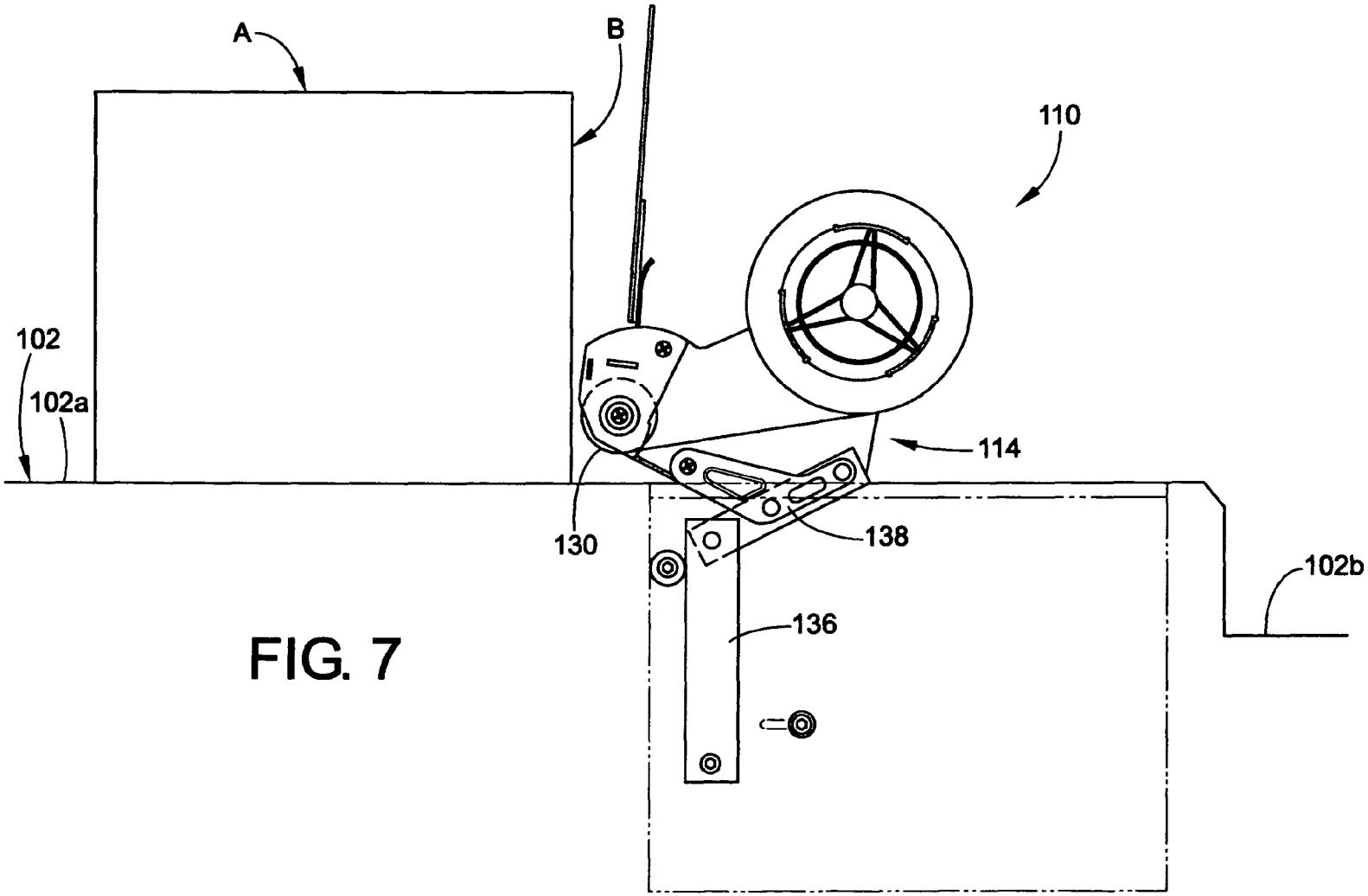
FIG. 7 is a side view of a portion of the case sealing machine of FIG. 1, illustrating a carton to be taped and the taping head assembly, with the housing shown transparently in phantom, in a first or initial taping position.
Figure 8:
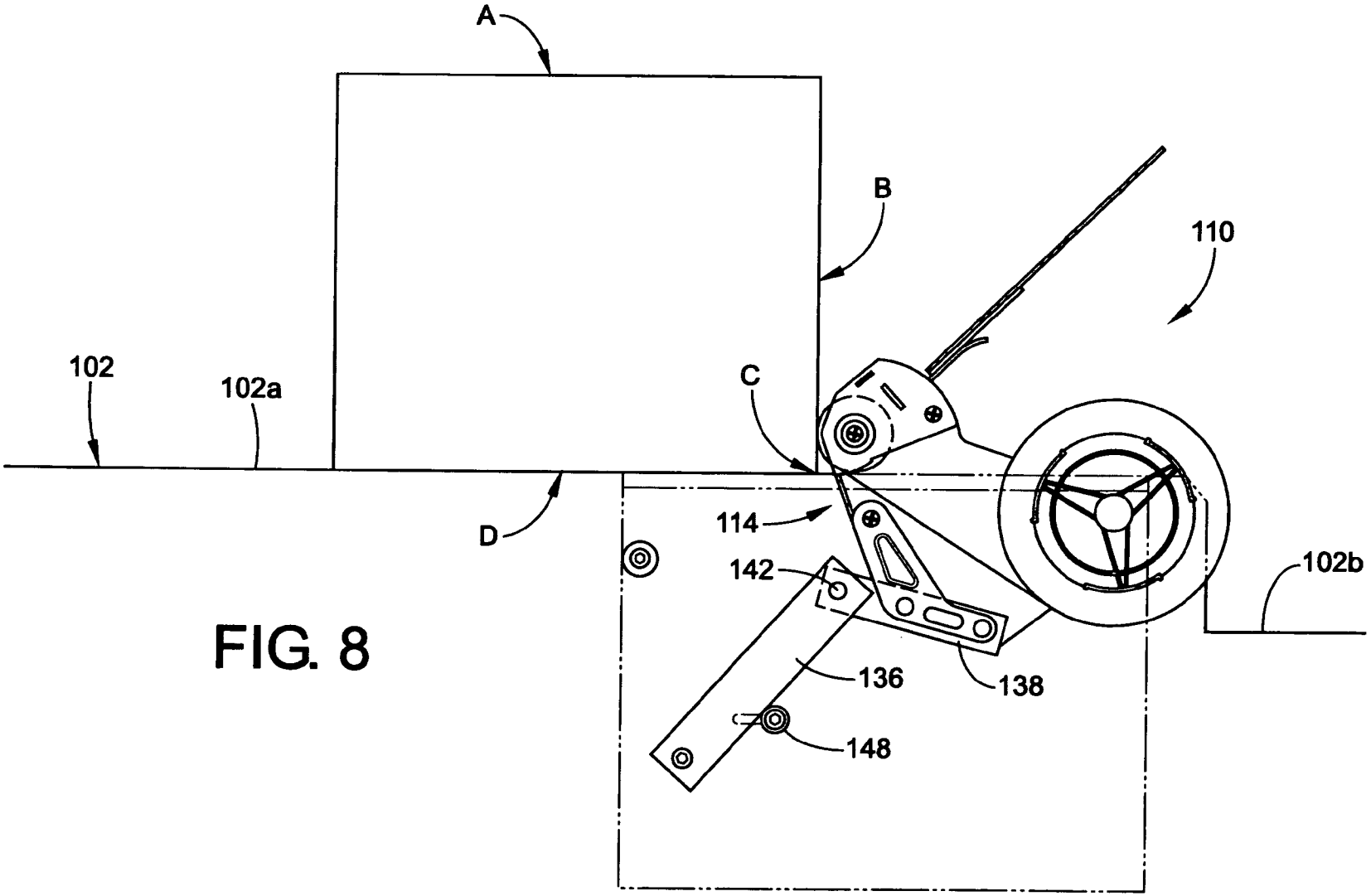
FIG. 8 is a side view of the case sealing machine of FIG. 1, illustrating the carton and the taping head assembly, with the housing shown transparently in phantom, in a second taping position.

Now with reference to FIGS. 7-10, the taping head assembly 110 is shown in various positions with respect to the associated case A and the work surface 102. Specifically, FIG. 7 illustrates the taping assembly 110 in a first or initial position. As illustrated, the taping head 114 is in an upper and forward-most position and the first and second arms 136,138 are fully against their respective forward stops. In the initial position, the leading end of the tape (with its adhesive facing outward) and/or the forward most portion of the application roller 130 contacts the forward wall surface B of the case A where the adhesive tape is first applied as it is driven into and over the taping assembly 110 (FIG. 8). Prior to contacting the forward wall surface B, the tape may be held in contact with or adjacent to the application roller 130 due to a difference in electrostatic charge between the tape, application roller 130, and/or a cross member 154 (FIGS. 4 and 5). To enhance and/or prolong the electrostatic charge therebetween, the cross member 154 (FIGS. 4 and 5) may include an electrostatic retention member, coating, or other insulating material (e.g. glass, silk, rubber, acrylic, PVC, ABS, or any other plastic or polymer, etc.) having a triboelectric effect when brought into sliding or rolling contact with the cross member or the application roller 130. By enhancing or prolonging the retention of the electrostatic charge, the likelihood that the cut end of the tape adjacent the application roller 130 will become detached, fold over onto itself, or onto another portion of the taping assembly 110 is greatly reduced. Thus, the uninterrupted service and overall reliability of the sealing machine can be improved.

With reference to FIG. 8, the taping assembly 110 is shown in a second or intermediate position. When the case is driven into and over the taping assembly 110, the first arm 136 pivots rearwardly until it contacts the first arm rear stop 148 as the tape plays out from the roll G. At this point, the second arm 138 and the taping head 114 have not rotated about the second pivot 142 or moved with respect to the first arm 136. Generally, by way of example only with respect to the instant embodiment, better taping action may occur if the first arm 136 rotates fully prior to the rotation of the second arm 138. If the second arm 138 were to rotate first or concurrently with the first arm 136 it is possible that the case A might interfere with the support plates or frame of the taping head 114 making it more difficult for the user to push the case A through the machine. It should also be noted that the second position of the taping head 114 shown in FIG. 8 generally represents the taping transition point between the forward wall surface B, the lower forward edge C, and the bottom wall surface D of the case A.

Figure 9:
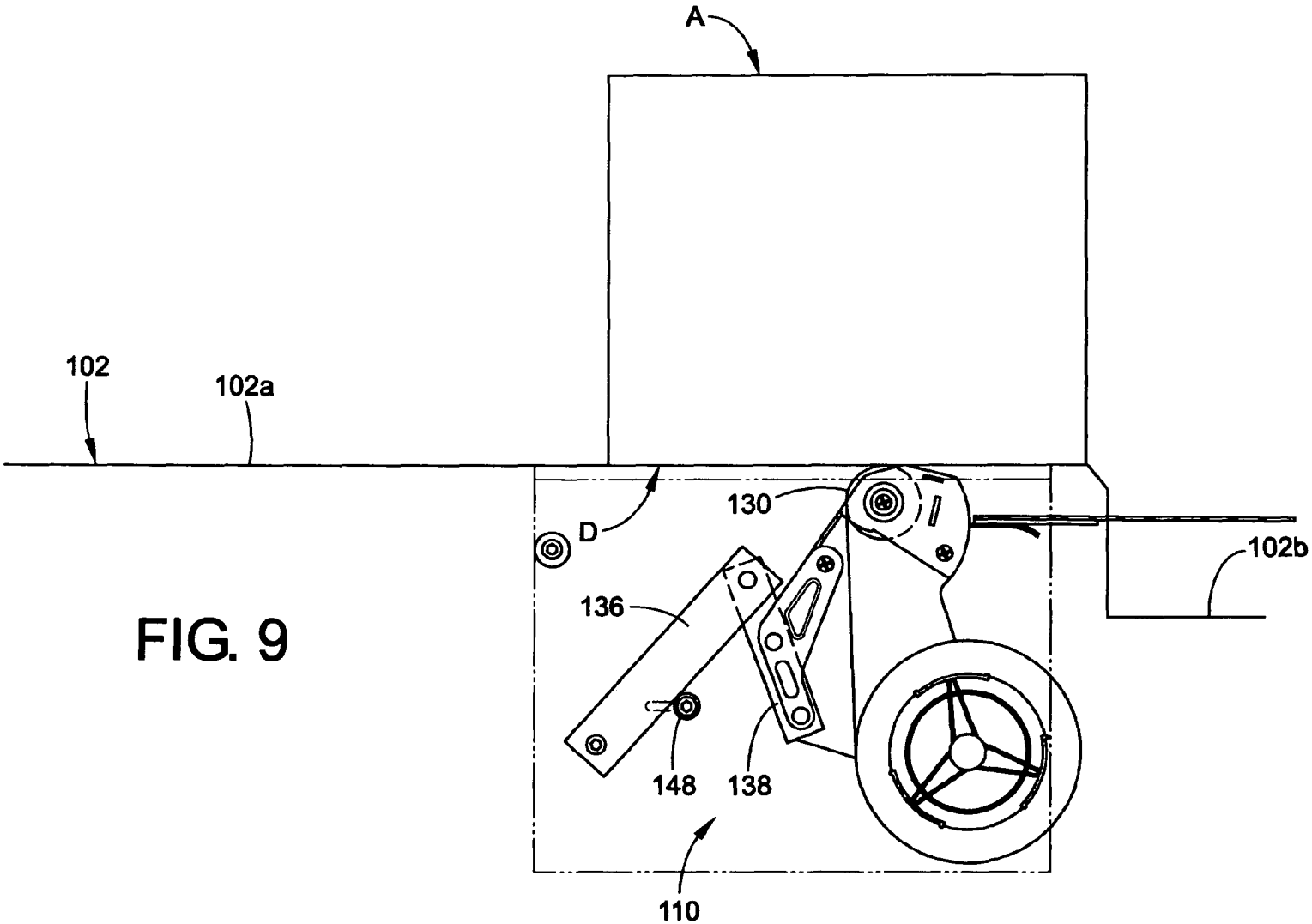
FIG. 9 is a side view of the case sealing machine of FIG. 1, illustrating the carton and the taping head assembly, with the housing shown transparently in phantom, in a third taping position.

With reference to FIG. 9, a third intermediate position of the taping assembly 110 is shown. In the third position, the first arm 136 continues to rest against the first arm rear stop 148 while the second arm 138 rotates to its fully downward/rearward position and against the second arm rear stop 152 (FIG. 6). In this orientation, the supporting plates or frame of the taping assembly will not interfere with the case as is it driven through the machine. With the second arm 138 fully rotated, the application roller 130 may protrude slightly above the generally horizontal work surface 102. This protrusion ensures that the tape positively contacts the bottom wall surface D of the case A as it passes over the roller 130. Depending on the amount of protrusion (which is a function of the rear stop setting for both first and second arms) this interference between the application roller 130 and the bottom wall surface D (FIG. 2) of the case can produce a substantial normal force therebetween.

Figure 10:
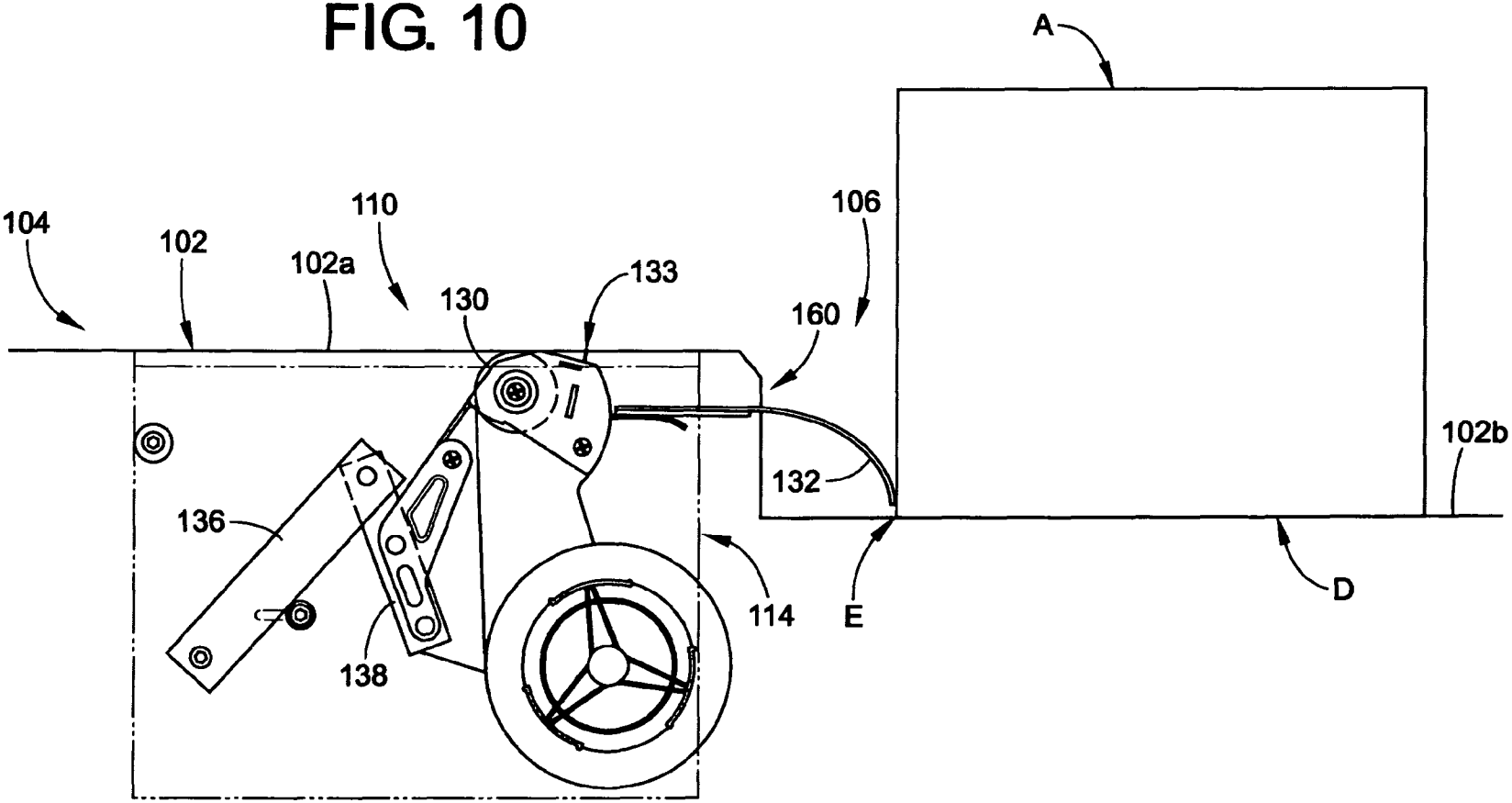
FIG. 10 is a side view of the case sealing machine of FIG. 1, illustrating the carton and the taping head assembly, with the housing shown transparently in phantom, in a fourth or final taping position.

With respect to FIG. 10, the taping assembly 110 is shown in a final or rear wall taping or wiping down position. As the rear edge of the case A passes, the application roller 130, the taping head 114 generally remains in the final or taping position because the adhesive tape has not yet been cut. After the rear edge E of the case A moves past the application roller 130 of the taping head 114, the case A encounters a drop 160 from the first elevation 102*a* of the entry region 104 of the work surface 102 to the second elevation 102*b* of the exit region 106. As the case A drops, the tape is pulled past or into contact with the cutter or cutting edge 133 and the wiper arm 132 (which is in contact with the bottom wall surface D) is deflected downward as the case A drops. As the wiper arm 132 is deflected downward, the cutter 133 is activated causing the cutting edge to protrude into the path of the tape thereby severing the tape. Once the tape is cut, the wiper arm 132 springs upward "wiping down" the trailing cut end portion of the tape against the rear wall surface of the case as the first and second biasing members 144, 145 (FIG. 4) bias the first and second arms 136,138 into the first or initial position.

The wiper arm may include one or more layers each having various thicknesses and/or varying stiffness. The wiper can be stiffer at a base portion (near the taping head) and more flexible at a tip portion (farthest away from the taping head). A stiffer base portion ensures that the taper cutter will be activated as the case drops from the first level to the second level while a flexible tip portion ensures a good "wipe down" of the cut end portion of the tape.

It should be noted that both the "wiping down" action and the tape cutting are enhanced by the elevation change between the entry region and the exit region of the work surface. Furthermore, the transition between the entry region level and the exit region level can be accomplished in any number of ways. For example, a rounded or eased transition between the elevation of the entry region and the elevation of the exit region can be used as illustrated in the first embodiment. On the other hand, given a particular case design, size, or application other geometries including triangular, stepped, or curvilinear ramps may be used. Further still, the transition regions or ramps on either side of the taping assembly can be of dissimilar height so as to cause the case to tilt or drop unevenly thereby further enhancing the cutting action of the tape cutter.

Figure 11:
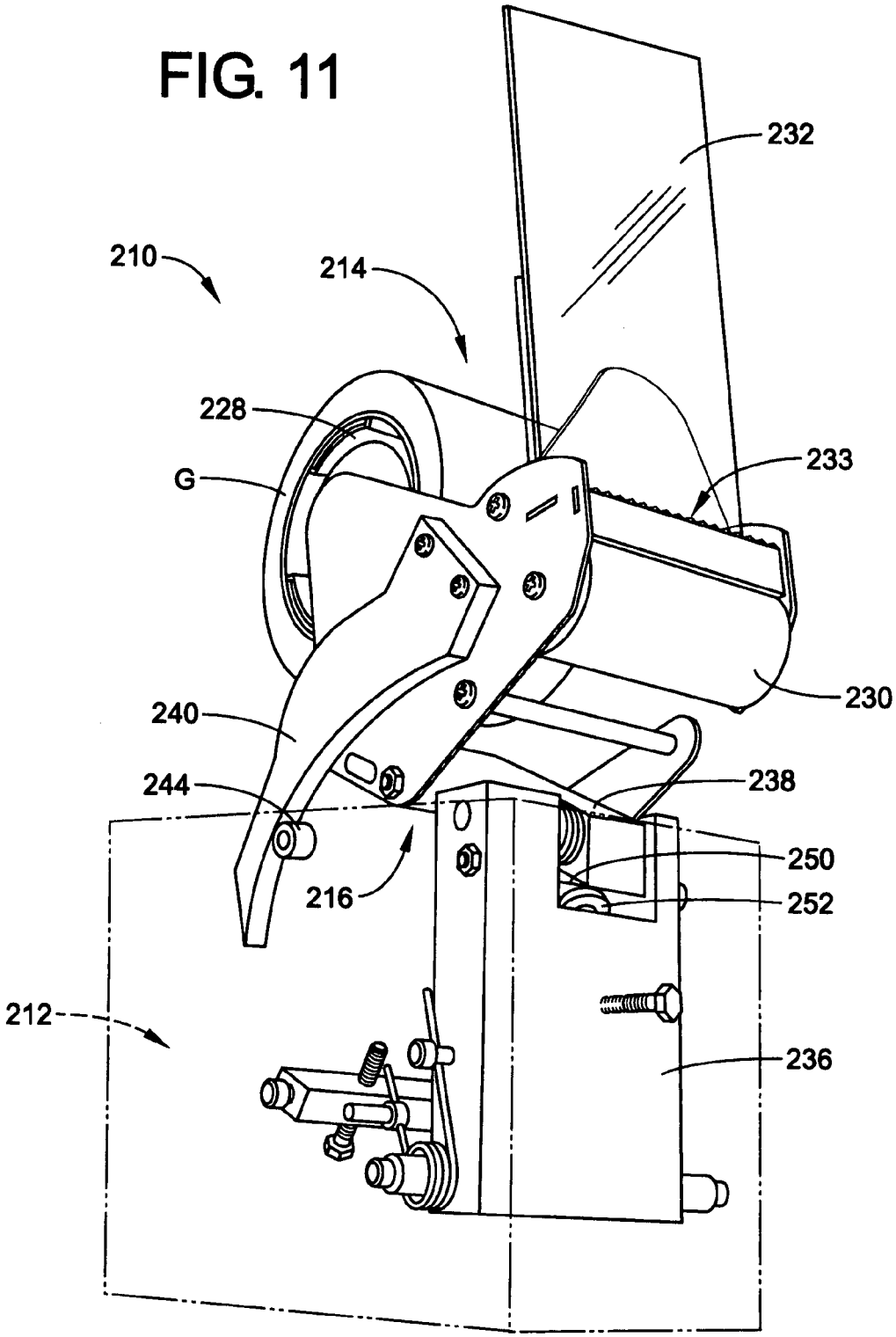
FIG. 11 is a perspective view from a front side of a second embodiment of a taping head assembly, with a housing shown transparently in phantom, for a case sealing machine including a curvilinear taping head guide.
Figure 12:
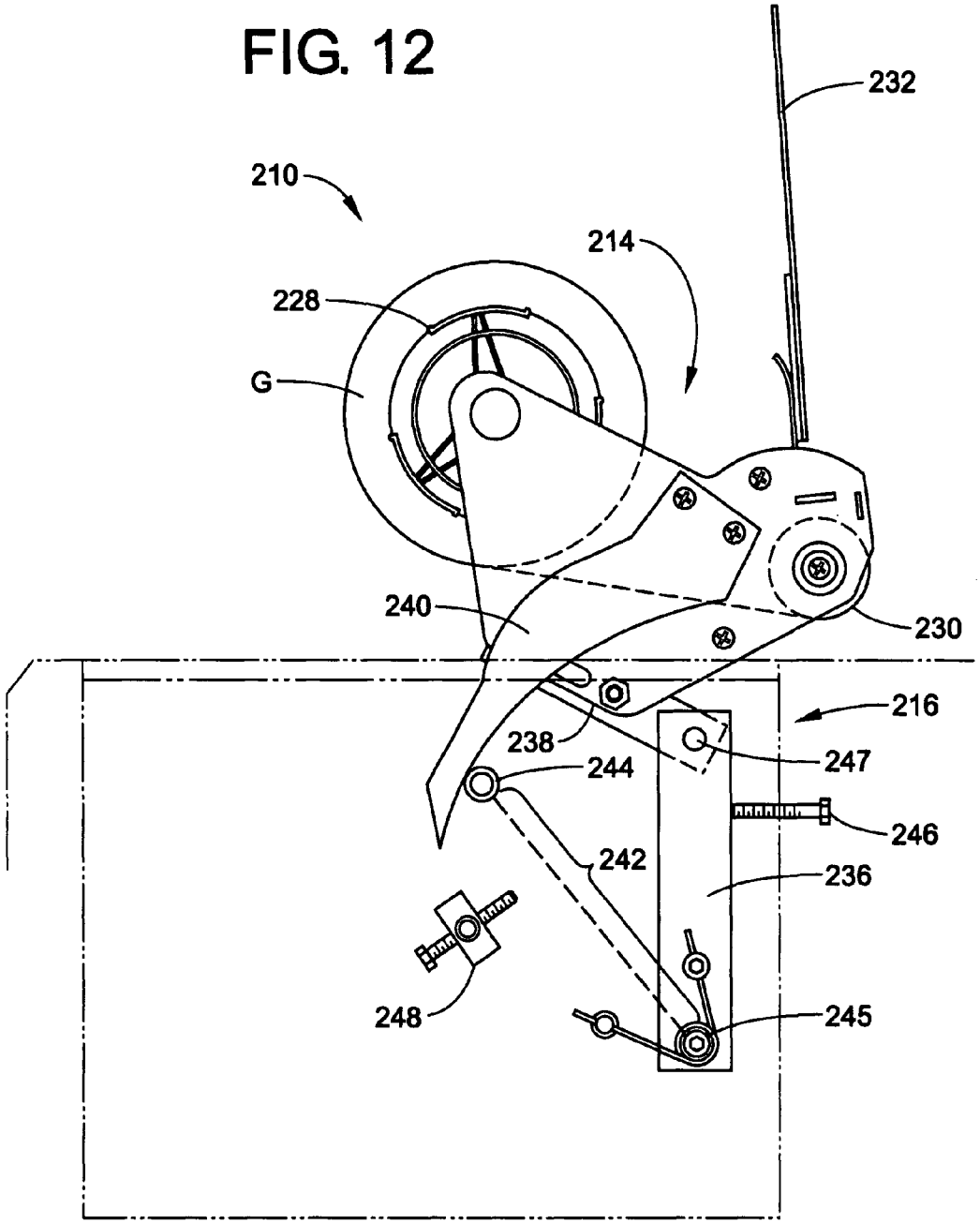
FIG. 12 is a side view of the taping head assembly of FIG. 11, illustrating a taping head, a taping head linkage, and the curvilinear taping head guide.

With reference now to FIGS. 11 and 12, a second embodiment of a taping assembly 210 is shown. As with the first embodiment, the taping assembly 210 includes a frame or housing 212 for supporting a taping head 214 and a taping head linkage 216. In addition, the frame 212 is secured to a generally planar work surface (e.g. a table). As shown in FIG. 8, the taping head 214 includes a tape roll 228 for receiving the roll of adhesive tape G, an application roller 230, and a wiper arm 232. As before, the taping head includes a wiper arm activated tape cutter 233. Similar to the first embodiment, the taping head linkage 216 of the second embodiment also includes a first arm or link 236 and a second arm or link 238. The second arm 238 includes a curvilinear taping head guide 240 rigidly secured thereto. In addition, a third arm or stationary link 242 (shown in dashed) is defined between a guide roller 244 and a primary pivot 245. The first arm 236 pivots about the primary pivot 245 and the second arm 238 pivots about a secondary pivot 247 disposed at a distal end of the first arm 236.

As mentioned previously, the curvilinear taping head guide 240 may be rigidly secured to the second arm 238 and can be in rolling contact with the guide roller 244. As with the first embodiment, as a partially erected case or carton is brought into contact with the application roller 230, the taping head 214 pivots rearwardly about the primary and secondary pivots 245,247. However, the primary distinction with the second embodiment is that the taping head 214 must follow the proscribed curvilinear path as defined by the taping head guide 240 as it rolls downward along the guide roller 244. As such, the first and second arms may move in independently or in concert as necessary to follow the proscribed curvilinear path.

In addition, the taping assembly 210 includes various adjustable limits or stops. As before, these stops define the uppermost and lowermost positions of the taping head 214. In particular, the first arm 236 includes a forward stop 246 and a rear stop 248. As shown, both first arm stops 246,248 consist of a threaded fastener which may be threaded in or out to adjust the overall travel of the first arm 236. Also, the second arm 238 includes a forward stop 250 and a rear stop 252 which are the same or nearly identical to those of the first embodiment. The second arm forward and rear stops of the second arm could also involve a block slideably secured or attached to a rear surface of the first arm 236. In either case, the overall travel of the second arm 238 can be adjusted with respect to the first arm 236. In addition, a slot may be provided in the taping assembly housing 212 so that the guide roller 244 may be adjustable in a vertical and or horizontal direction. Adjusting the guide roller 244 would allow the curvilinear taping head guide 240 of the second arm to pivot more or less abruptly. In addition, the guide roller 244 (or cam follower) may be a rotating bearing element or a pin that travels along a low friction track or slot in either of the housing 212 or the curvilinear guide member 240.

It should also be noted that the dual pivot design of the present invention allows for a much more compact design and for the option of varying the tension between the first arm and the second arm of the taping head linkage. If a single lever design were used, the overall length of the single lever or arm would have to be considerably longer than the present design. This would drastically increase the overall horizontal length of the machine. In addition, by providing separate tensioning or biasing members for the first and second arms, it is easier for the user to push a case through the machine rather than struggling to overcome the force needed to unroll the tape and to deflect the main biasing member. Naturally, the biasing members can take on any number of devices such as a spring, weight, pneumatic cylinder, or gas charged damper.

As noted previously, several adjustments can be made to alter the overall starting and ending positions of the taping assembly. In particular, the forward stop of the first arm should be adjusted so that the first arm is near vertical when the taping assembly is in the initial or starting position. This ensures that adhesive tape is not immediately under tension when the taping head begins to move rearward. In addition, the forward stop of the first arm should be adjusted so that the tape head is leaning forward at approximately a 10° angle to expose the maximum amount of tape to be rolled against the case and to help prevent any excessive amount of unrolled tape from becoming entangled. The rear stop of the first arm should be adjusted so that the support plates clear the work surface. And, the rear stop of the second arm should be adjusted so that the application roller is level with or slightly above the work surface. Furthermore, the stops may include preset positions or detents to accommodate a variety of taping conditions. The stops may also include bumpers fabricated from a soft or low durometer material, hydraulic dampers, and/or springs to reduce shock to the linkage arms and other components of the taping head assembly. Lastly, an unwind brake (provided on the tape roll to maintain positive tension) should be adjusted just tight enough to ensure a consistent cut by the tape cutter.

As is apparent from the above discussion, the present invention offers several advantages over known case sealing equipment. For one, the present invention provides a faster and easier technique for applying tape to a case as compared to a conventional hand taping gun. Rather than the user rotating the tape or hand taping gun about the case, the user instead pushes the case in a straight line along a generally flat work surface. This eliminates any user error in the proper application, alignment, and smoothing of the tape to the case. Furthermore, because pushing a case along a straight line is less stressful on a user's wrists as compared to rotating or manipulating a conventional hand taping gun, the risk of developing or aggravating carpel tunnel syndrome and/or other work related injuries is greatly reduced. In addition, the present invention requires no electricity as it is entirely human powered. A human or manually powered machine has the added benefit of making the device less expensive, more reliable, and simpler to use.

The exemplary embodiments have been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. A method of sealing a surface of a case to be sealed with tape, the method comprising:

advancing a case to be sealed along a work surface;

contacting a first end of a length of the tape extending along an applicator surface with a first wall surface of the advancing case to adhere the first end of the tape to the first wall surface;

with continued advancement of the case to be sealed, rotating a linkage that supports the applicator surface while dispensing the tape against the first wall surface of the advancing case;

with continued advancement of the case to be sealed, rotating the linkage further to cause the applicator surface to round a forward edge of the advancing case;

with continued advancement of the case to be sealed, pressing the tape against a second wall surface of the advancing case; and with continued advancement of the case to be sealed, lowering the case to be sealed through a taping drop region from a first elevation to a second lower elevation and concurrently cutting the tape by depressing a flexible wiper arm and adhering a cut end portion of the tape against a third wall surface of the advancing case with the flexible wiper arm.

2. The method of claim 1, wherein the step of adhering the cut end portion of the adhesive tape includes, flexing the wiper arm upward as the case drops downward to the second lower elevation to wipe the cut end portion against the third wall surface with the wiper arm.

3. The method of claim 2, further including:

flexing the wiper arm as the case drops downward to the second lower elevation and as the case advances on the second lower elevation unflexing the wiper arm to further wipe down the cut portion of the tape against the third wall.

4. The method of claim 1, further including:

concurrently with the rotating the linkage, rotating a first arm of the linkage and subsequently rotating a second arm of the linkage.

5. The method of claim 4, further including:

concurrently with rotating the first arm and the second arm of the linkage, urging the first arm towards an initial position with a first biasing force and urging the second arm towards the initial position with a second biasing force.

6. The method of claim 4, wherein the steps of rotating the first arm and the second arm of the linkage further include pivoting the applicator surface in a curvilinear fashion.

7. A case sealing device for applying a sealing tape to a surface of a case to be sealed, the device comprising:

a work surface, a first portion of the work surface defining an entry region having a first elevation and a second portion of the work surface defining an exit region having a second lower elevation;

a taping assembly mounted adjacent the work surface between the entry region and the exit region, the taping assembly including a taping head and a taping head linkage, the linkage having a rotatable first end and a second end, the second end being secured to the taping head, the taping head being adapted to hold an associated roll of tape, the taping head and the taping head linkage being configured to cooperate to dispense a strip of the tape from the taping head onto the surface of the case to be sealed as the case to be sealed is brought into contact with the taping assembly during sliding movement from the entry region to the exit region of the work surface;

a taping drop region defined between the entry region and the exit region and adjacent the taping assembly in which the case to be sealed is lowered from the first elevation to the second lower elevation; and a flexible wiper arm mounted to the taping assembly, the wiper arm extending into the taping drop region as the case reaches the taping drop region and configured to slidably engage and facilitate taping of a trailing face of the case to be sealed as the case moves through the taping drop region from the first elevation of the entry region to the second lower elevation of the exit region.

8. The case sealing device of claim 7,further including:

a self-centering guide assembly mounted to the work surface proximal to the entry region of the work surface to center and guide the case to be sealed toward the taping assembly.

9. The case sealing device of claim 7, wherein the taping assembly includes:

an application roller carried by the linkage to apply the tape to the case to be sealed; and a biasing member which biases the linkage to urge the application roller against a forward face of the case to be sealed as the case to be sealed slides towards the application roller and as the linkage pivots about the first end and continues to bias the linkage to continue to urge the application roller against a lower surface of the case to be sealed.

10. The case sealing device of claim 7, wherein the taping head linkage includes a first arm and a second arm, a first end of the first arm being mounted to permit rotation relative to the work surface, a second end of the first arm being rotatably connected to a first end of the second arm, a second end of the second arm being connected with the taping head.

11. The case sealing device of claim 7, wherein the taping head rotates downward relative to the work surface in response to engagement with the case and the flexible wiper arm extends from the taping head in a direction of movement of the case when the case is adjacent the drop region and the flexible wiper arm being configured to wipe down a cut end portion of the dispensed tape as the case moves downward in the taping drop region.

12. The case sealing device of claim 7, further including:

one or more of a linear, curved, or stepped profile disposed to slidably engage and facilitate the taping of the case to be sealed as the case moves from the first elevation of the entry region to the second lower elevation of the exit region.

13. The case sealing device of claim 7, wherein the taping assembly further includes:

a taping head guide and a follower member, the guide being secured to one of the taping head or the housing and the follower member being secured to the other of the taping head or the housing, the guide including a curvilinear profile, the guide and the follower member cooperate to pivot the taping head in a curvilinear fashion as the taping assembly moves between an initial starting position and an ending position.

14. The case sealing device of claim 7, wherein the linkage is connected with an applicator surface which presses the tape against an advancing case to be sealed, the linkage being configured to pivot about the first end in response to pressure from the advancing case and wherein the taping assembly further includes a biasing structure which biases the applicator surface against a forward surface of the advancing case and a lower surface of the advancing case.

15. The case sealing device of claim 14, wherein the biasing structure further biases the taping assembly toward returning to an initial position after the advancing case has passed the applicator surface and wherein the taping head further includes:

a cutter which cuts the tape as the advancing case moves toward the second portion of the work surface leaving an unapplied end section of the tape; and a flexible wiper which applies the unapplied end section of the tape to the case.

16. The case sealing device of claim 15, wherein the cutter includes an extended position and a retracted position, the cutter being urged into the extended position to cut the tape when the wiper is depressed in a downward direction by the advancing case.

17. The case sealing device of claim 7, wherein the taping assembly includes an electrostatic retention member for electrostatically maintaining an end portion of the associated roll of tape in contact with a portion of the taping assembly.

* * * * *